United States Patent [19]

Eggert

[11] 4,129,257

[45] Dec. 12, 1978

[54] JET MOUTH PIECE

[76] Inventor: Uwe Eggert, Fyrkloversgatan 68, 417 21 Goteborg, Sweden

[21] Appl. No.: 746,895

[22] Filed: Dec. 2, 1976

Related U.S. Application Data

[63] Continuation of Ser. No. 515,609, Oct. 17, 1974, abandoned.

[30] Foreign Application Priority Data

Oct. 23, 1973 [SE] Sweden ..... 7314346

[51] Int. Cl.[2] ..... B05B 1/32

[52] U.S. Cl. ..... 239/458; 239/460; 239/582

[58] Field of Search ..... 239/456, 457, 458, 460, 239/579, 581, 582; 403/362

[56] References Cited

U.S. PATENT DOCUMENTS

| | | | |
|---|---|---|---|
| 1,466,965 | 9/1923 | Savage | 239/458 |
| 2,552,444 | 5/1951 | Nielsen | 239/458 |
| 2,955,766 | 10/1960 | Nielsen | 239/458 X |
| 3,012,733 | 12/1961 | Allenbaugh, Jr. | 239/458 |
| 3,347,110 | 10/1967 | Wilson | 403/362 X |

*Primary Examiner*—Joseph F. Peters, Jr.
*Assistant Examiner*—Michael Mar
*Attorney, Agent, or Firm*—William Anthony Drucker

[57] ABSTRACT

A nozzle intended for a jet-pipe working with a pressurized liquid with said nozzle comprising a throttle valve head surrounded by an orifice sleeve and being pendulum-like supported by a longitudinal shaft pointing in counter-current direction, wherein the orifice sleeve constitutes one of two sleeves being rotatably journalled on each other, one of the sleeves having a runner being in mesh with a guide in the other one of the sleeves, the guide having a pitch in order to give the valve head a positively controlled axial movement by rotating the sleeves in between, the shaft is supported by a transverse shaft which extends in the diametrical direction through the inner sleeve, the transverse shaft extends through the wall of the connection sleeve into the guide, the latter being constituted by a slit made in the orifice sleeve .

2 Claims, 2 Drawing Figures

JET MOUTH PIECE

This is a continuation of Application Ser. No. 515,609, filed Oct. 17, 1974.

The present invention relates to a mouth piece for a jet tube working with a liquid under high pressure.

It is a principal object of the invention to provide a mouth piece of simple construction for a jet tube to be used preferably for fire extinguishing purpose and similar, and which mouth piece exhibits a good function even if certain inaccuracy with respect to the tolerances should have resulted during its manufacturing.

Said purpose is reached by means of a jet mouth piece according to the invention, substantially characterized by a throttle valve head located in centric position in a sleeveshaped orifice piece and axially displaceable relative to said orifice piece, said valve head being supported in a pivotlike mounting by a shaft pointing in countercurrent direction.

Figure 1:
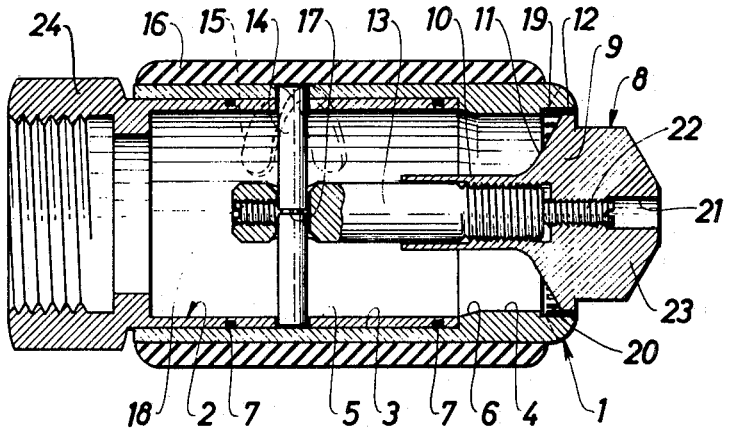
Figure 2:
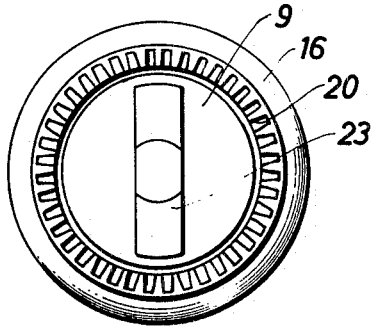

In the following the object of the invention is described with reference to the accompanying drawing, in which FIG. 1 is a longitudinal cross sectional view through a jet mouth piece made in accordance with the invention, and FIG. 2 is a front view of said mouth piece, i.e. a view taken from the right in FIG. 1.

The jet mouth piece illustrated in the drawing comprises a sleeveshaped orifice piece generally indicated by reference numeral 1, and a connecting sleeve 2, which is pivotably and displaceably mounted in said orifice piece. The orifice sleeve 1 exhibits two substantially cylindrical bored portions 3 and 4 respectively, one of which located near the orifice exhibiting a smaller diameter than the portion located further backwards. The portion 5 of the connecting sleeve 2 mounted in the orifice piece exhibits a wall thickness, which is less than the difference between the radii of the two bored portions 3 and 4. In order to obtain as uniform a flow as possible, the bored portion 4 located at the front therefore connect with the inner wall of the connecting sleeve via a conically tapered surface portion 6. Two peripherically extending grooves are made in the connecting sleeve at a certain axial distance in between them, which each receive an O-ring 7 tightening against the innerwall of the sleeve. A valve body 8 is designed with a platelike head 9 with a rear portion 11, which from a cylindrically shaped portion 10 widens in the forward direction, and which at the periphery of the valve head passes to a substantially cylindrical surface 12. In its front portion the valve head 9 exhibits a cam shaped projection 23 serving the purpose of a hand grip. The tube shaped cylinderbody portion 10 is provided with an internal thread and is screwed onto one end of a longitudinal shaft 13 pointing in the countercurrent direction, which shaft towards its rear end through a diametrically extending bore which is traversed by a transverse shaft 14 extending substantially in diametrical direction relative to the two sleeves. The shaft 14 extends through two diametrically opposed bores in the wall of the connection sleeve 2. In addition one end of said shaft penetrates into a slot 15 provided in the orfice sleeve 1, said slot being made with a pitch in the longitudinal direction of the mouth piece. An additional sleeve 16, which preferably can be made of rubber or other material easy to grip, mats with the orifice sleeve. A groove 17 has been made in the shaft 14 in centric location in the mouth piece, which groove is engaged by the end portion of a lockscrew 18 screwed in from the rear end of the shaft 13. The cross bore of the shaft 13 through which the shaft 14 is led exhibits a diameter, which is so much greater than the diameter of the shaft 14, that the valve head 9 is permitted to pivot freely between the inner walls of the orifice sleeve. Towards the front end of the orifice sleeve the bore 4 passes to a somewhat wider bore portion 19, in which a number of radially extending slits 20 are made, the limiting rear edges of which are substantially parallel to the rear wall 11 of the valve body. A lock screw 22 is screwed into a bore in the valve body from the front end, which lockscrew can be made to abut against the end of the shaft 13, by means of which the valve head can be locked in any desired screwed-in position. By pivoting the orifice sleeve 1 relative to the connecting sleeve 2 the valve head can be given a longitudinal movement relative to the front end portion of the orifice sleeve between a forward cleaning position, which is the one illustrated in the drawing, and in which the jet of liquid obtains a comparatively strong spread, and a rear position, in which the jet of liquid is comparatively concentrated. By the pivotlike suspension of the valvehead the jet will be selfcentering and thus will not be dependent upon by, way of example, any ovalness or other deficiency of the measure tolerances of the orifice sleeve. By screwing the valve head onto the shaft said valve head can easily be exchanged. The slot 15 can suitably be made with a comparatively small pitch in its rear part and a comparatively great pitch in its front part, which means that the valve head by a comparatively small force can be adjusted also in its rear position, in which the pressure of the liquid acting upon the same is greatest. By the gradual increase of the pitch is forward direction the valve head anyhow can be brought to carry out a comparatively great axial movement without the pivoting movement necessarily resulting unreasonably great. The slot can suitably exhibit a steep changeover at the passage between one portion and another exhibiting different pitches, the passage corresponding the position of the shaft 14, when the valve head is in a suitable working position. The fine adjustment of the valve head in said position can suitably be carried out by pivoting the valvehead on the shaft 13 followed by locking. The mouth piece illustrated in the drawing is very easy to mount as well as to demount, and during its use all parts are very efficiently kept in place. The shaft 14 can suitably be stuffed in the bores of the connection sleeve by means of a suitable tightening medium. The mouth piece can suitably be connected with a jet tube intended for fire extinguishing by means of its socket 24 preferably being made in the shape of an hexagonal bushing.

The invention is not limited to the embodiment described above and illustrated in the drawing by way of example only, but can be varied as to its details within the scope of the following claims.

I claim:

1. A nozzle intended for a jet-pipe working with a pressurized liquid, said nozzle comprising a throttle valve head, a longitudinal shaft extending in a countercurrent direction, having a lateral opening and being adjustably connected to said valve head, a pair of sleeves being rotatably journalled on each other, one of said sleeves being an orifice sleeve surrounding said valve head and having a guide slot, the other of said sleeves having a pair of opposed openings with one of said opening communicating with said guide slot, a transverse shaft extending through said longitudinal shaft lateral lateral opening, means for pivotally supporting said longitudinal shaft on said transverse shaft for swingable movement in any direction, said transverse shaft also extending through said other sleeve openings into said orifice sleeve guide slot, and said guide slot having a pitch such as to give said orifice sleeve a positively controlled axial movement upon the rotation of said orifice sleeve.

2. A nozzle as claimed in claim 1 wherein said longitudinal shaft has a threaded opening communicating with said lateral opening, said transverse shaft has an annular central groove and a lockscrew is in threaded engagement with said threaded opening and has a pointed end extending into said annular groove.

* * * * *